US011619232B2

(12) United States Patent
Coeckelbergs et al.

(10) Patent No.: US 11,619,232 B2
(45) Date of Patent: Apr. 4, 2023

(54) LIQUID RING PUMP CONTROL

(71) Applicant: Edwards Technologies Vacuum Engineering (Qingdao), Co. Ltd., Qingdao (CN)

(72) Inventors: Joeri Coeckelbergs, Cologne (DE); Mark Gordon Glaister, Bolton (GB); Andries Daniel Jozef De Bock, Qingdao (CN)

(73) Assignee: Edwards Limited, Burgess Hill (GB)

( * ) Notice: Subject to any disclaimer, the term of this patent is extended or adjusted under 35 U.S.C. 154(b) by 0 days.

(21) Appl. No.: 16/977,770

(22) PCT Filed: Mar. 14, 2019

(86) PCT No.: PCT/IB2019/052071
§ 371 (c)(1),
(2) Date: Sep. 2, 2020

(87) PCT Pub. No.: WO2019/175822
PCT Pub. Date: Sep. 19, 2019

(65) Prior Publication Data

US 2021/0010474 A1 Jan. 14, 2021

(30) Foreign Application Priority Data

Mar. 14, 2018 (GB) ..... 1804105

(51) Int. Cl.
*F04C 25/02* (2006.01)

(52) U.S. Cl.
CPC ..... *F04C 25/02* (2013.01); *F04C 2210/1094* (2013.01); *F04C 2210/22* (2013.01); *F04C 2270/18* (2013.01); *F04C 2270/19* (2013.01)

(58) Field of Classification Search
CPC ..... F04C 25/02; F04C 2210/1094; F04C 2210/22; F04C 2270/18; F04C 2270/19
See application file for complete search history.

(56) References Cited

U.S. PATENT DOCUMENTS 4,087,208 A 5/1978 Uda et al.
4,699,570 A 10/1987 Bohn
(Continued)

FOREIGN PATENT DOCUMENTS

CA 2235248 A1 10/1999
CN 106089716 A 11/2016
(Continued)

OTHER PUBLICATIONS

Combined Search and Examination Report under Sections 17 and 18(3) dated Sep. 18, 2018 from counterpart GB Application No. 1804105.3, 6 pp.
(Continued)

*Primary Examiner* — Connor J Tremarche
(74) *Attorney, Agent, or Firm* — Shumaker & Sieffert, P.A.

(57) ABSTRACT

A control system comprising: a suction line; an exhaust line; an operating liquid line; a liquid ring pump comprising a suction input coupled to the suction line, an exhaust output coupled to the exhaust line, and a liquid input coupled to the operating liquid line; a motor configured to drive the liquid ring pump; a first sensor configured to measure a first parameter of an exhaust fluid of the liquid ring pump; a second sensor configured to measure a second parameter of a gas being received by the liquid ring pump via the suction line; and a controller operatively coupled to the first sensor, the second sensor, and the motor, and configured to control the motor based on sensor measurements of the first sensor and the second sensor.

15 Claims, 4 Drawing Sheets

(56) References Cited

U.S. PATENT DOCUMENTS

| | | | | |
|---|---|---|---|---|
| 6,227,222 | B1 * | 5/2001 | Jennings | B01D 45/02 137/14 |
| 6,558,131 | B1 | 5/2003 | Nash | |
| 7,927,080 | B2 * | 4/2011 | Muller | F04C 19/004 417/53 |
| 2007/0110591 | A1 | 5/2007 | Urquhart et al. | |
| 2007/0119816 | A1 * | 5/2007 | Urquhart | H01L 21/67253 216/84 |
| 2011/0274592 | A1 * | 11/2011 | Salmisuo | A61L 2/26 422/292 |
| 2015/0030467 | A1 | 1/2015 | Spiess | |
| 2015/0139817 | A1 | 5/2015 | Kowalski | |
| 2015/0361979 | A1 * | 12/2015 | Kosters | F04C 19/004 417/54 |
| 2016/0177952 | A1 | 6/2016 | Larsen | |
| 2018/0245594 | A1 * | 8/2018 | Chabala | F04C 19/00 |

FOREIGN PATENT DOCUMENTS

| | | | |
|---|---|---|---|
| CN | 206111560 | U | 4/2017 |
| CN | 107246807 | A | 10/2017 |
| JP | H1182346 | A | 3/1999 |
| JP | 2000342903 | A | 12/2000 |

OTHER PUBLICATIONS

Written Opinion and International Search Report dated Jul. 3, 2019 from counterpart International Application No. PCT/IB2019/052071, 9 pp.

Translation of the First Office Action and Search Report from counterpart Chinese Patent Application No. 201980019141.9 dated Dec. 23, 2021, 10 pp.

Extended Search Report from counterpart European Application No. 19768032.5, dated Aug. 6, 2021, 8 pp.

* cited by examiner

LIQUID RING PUMP CONTROL

This application is a national stage entry under 35 U.S.C. § 371 of International Application No. PCT/IB2019/052071, filed Mar. 14, 2019, which claims the benefit of GB Application 1804105.3, filed Mar. 14, 2018. The entire contents of International Application No. PCT/IB2019/052071 and GB Application 1804105.3 are incorporated herein by reference.

TECHNICAL FIELD

The present disclosure relates to the control of liquid ring pumps.

BACKGROUND

Liquid ring pumps are a known type of pump which are typically commercially used as vacuum pumps and as gas compressors. Liquid ring pumps typically include a housing with a chamber therein, a shaft extending into the chamber, an impeller mounted to the shaft, and a drive system such as a motor operably connected to the shaft to drive the shaft. The impeller and shaft are positioned eccentrically within the chamber of the liquid ring pump.

In operation, the chamber is partially filled with an operating liquid (also known as a service liquid). When the drive system drives the shaft and the impeller, a liquid ring is formed on the inner wall of the chamber, thereby providing a seal that isolates individual volumes between adjacent impeller vanes. The impeller and shaft are positioned eccentrically to the liquid ring, which results in a cyclic variation of the volumes enclosed between adjacent vanes of the impeller and the liquid ring.

In a portion of the chamber where the liquid ring is further away from the shaft, there is a larger volume between adjacent impeller vanes which results in a smaller pressure therein. This allows the portion where the liquid ring is further away from the shaft to act as a gas intake zone. In a portion of the chamber where the liquid ring is closer to the shaft, there is a smaller volume between adjacent impeller vanes which results in a larger pressure therein. This allows the portion where the liquid ring is closer to the shaft to act as a gas discharge zone.

Examples of liquid ring pumps include single-stage liquid ring pumps and multi-stage liquid ring pumps. Single-stage liquid ring pumps involve the use of only a single chamber and impeller. Multi-stage liquid ring pumps (e.g. two-stage) involve the use of multiple chambers and impellers connected in series.

SUMMARY

The suction ability of a liquid ring vacuum pump can be influenced by adjusting the temperature of the operating liquid used in that liquid ring pump. For example, at high vacuum levels, greater liquid ring pump efficiency tends to be achieved by lowering the temperature of the operating liquid. Conventionally, where water is used as the operating liquid, the provision of lower temperature operating liquid is typically achieved by providing an open operating liquid circuit in which heated operating liquid from the liquid ring pump is expelled and replaced by cool, fresh operating liquid. Accordingly, liquid ring pumps can consume considerable amounts of fresh water.

The present inventors have realised it is desirable to provide for controlling of operating liquid temperature and/or pressure of a liquid ring pump in a way that minimises operating liquid and power consumption. Such control advantageously tends to reduce operating costs of the liquid ring pump.

The present inventors have further realised it is desirable to provide for controlling of a liquid ring pump in a way that prevents or opposes cavitation in that liquid ring vacuum pump. Cavitation tends to be a significant cause of wear and failure in certain liquid ring pumps, especially those operating at a low-pressure/high-vacuum condition. Such control advantageously tends to reduce or eliminate wear caused by cavitation.

In a first aspect, the present disclosure provides a control system comprising: a suction line; an exhaust line; an operating liquid line; a liquid ring pump comprising a suction input coupled to the suction line, an exhaust output coupled to the exhaust line, and a liquid input coupled to the operating liquid line; a motor configured to drive the liquid ring pump; a first sensor configured to measure a first parameter, the first parameter being a parameter of an exhaust fluid of the liquid ring pump; a second sensor configured to measure a second parameter, the second parameter being a parameter of a gas being received by the liquid ring pump via the suction line; and a controller operatively coupled to the first sensor, the second sensor, and the motor, and configured to control the motor based on sensor measurements of the first sensor and the second sensor.

The controller may be coupled to the motor via one or more variable frequency drives (e.g. a single variable frequency drive). The controller may control the motor via the one or more variable frequency drives.

The first parameter may be a temperature. The second parameter may be a pressure. The controller may be configured to calculate, determine, or estimate a vapour pressure of the operating liquid using the first parameter. The controller may be configured to control the motor based on a function of the second parameter and the calculated, determined, or estimated vapour pressure of the operating liquid. The vapour pressure of the operating liquid may be calculated, determined, or estimated to be:

$$P_{wv} = A * 10^{\left(\frac{m*T_1}{T_1+T_n}\right)}$$

where A is a constant, m is a constant, $T_n$ is a constant, and $T_1$ is the first parameter.

The function of the second parameter and the vapour pressure of the operating liquid may be:

$$\Delta P = P_1 - P$$

where $P_1$ is the second parameter, and $$P = P_{wv} + P_{offset}$$

where $P_{wv}$ is the vapour pressure of the operating liquid and $P_{offset}$ is an offset value.

The controller may be configured to determine an operating speed for the motor based on sensor measurements of the first sensor and the second sensor, and to control the motor in accordance with the determined operating speed. The controller may be a controller selected from the group of controllers consisting of a proportional controller, an integral controller, a derivative controller, a proportional-integral controller, a proportional-integral-derivative controller, a proportional-derivative controller, and a fuzzy logic controller.

The control system may further comprise an operating liquid recycling system configured to recycle operating liquid in the exhaust fluid of the liquid ring pump back into the liquid ring pump. The operating liquid recycling system may comprise a separator configured to separate operating liquid from the exhaust fluid of the liquid ring pump. The operating liquid recycling system may comprise a cooling means configured to cool the recycled operating liquid prior to the recycled operating liquid being received by the liquid ring pump.

The control system may further comprise a non-return valve disposed on the suction line and configured to permit fluid flow into the liquid ring pump and to oppose fluid flow out of the liquid ring pump. The control system may further comprise one or more spray nozzle disposed on the suction line and configured to receive operating fluid and to spray the received operating fluid into the suction line. For example, the one or more spray nozzles may be configured to receive operating fluid via the operating liquid line.

The control system may further comprising: one or more regulating devices configured to control flow of the operating liquid into the liquid ring pump. The control system may further comprise a third sensor configured to measure a third parameter, the third parameter being a parameter of an operating liquid received by the liquid ring pump via the operating liquid line. The controller may be further operatively coupled to the third sensor and the one or more regulating devices, and configured to control the one or more regulating devices based on sensor measurements of the first sensor and the third sensor.

In a further aspect, the present disclosure provides a control method for controlling a system. The system comprises: a suction line; an exhaust line; an operating liquid line; a liquid ring pump comprising a suction input coupled to the suction line, an exhaust output coupled to the exhaust line, and a liquid input coupled to the operating liquid line; and a motor configured to drive the liquid ring pump. The method comprises: measuring, by a first sensor, a first parameter, the first parameter being a parameter of an exhaust fluid of the liquid ring pump; measuring, by a second sensor, a second parameter, the second parameter being a parameter of a gas being received by the liquid ring pump via the suction line; and controlling, by a controller operatively coupled to the first sensor, the second sensor, and the motor, based on sensor measurements of the first sensor and the second sensor, the motor.

DETAILED DESCRIPTION

Figure 1:
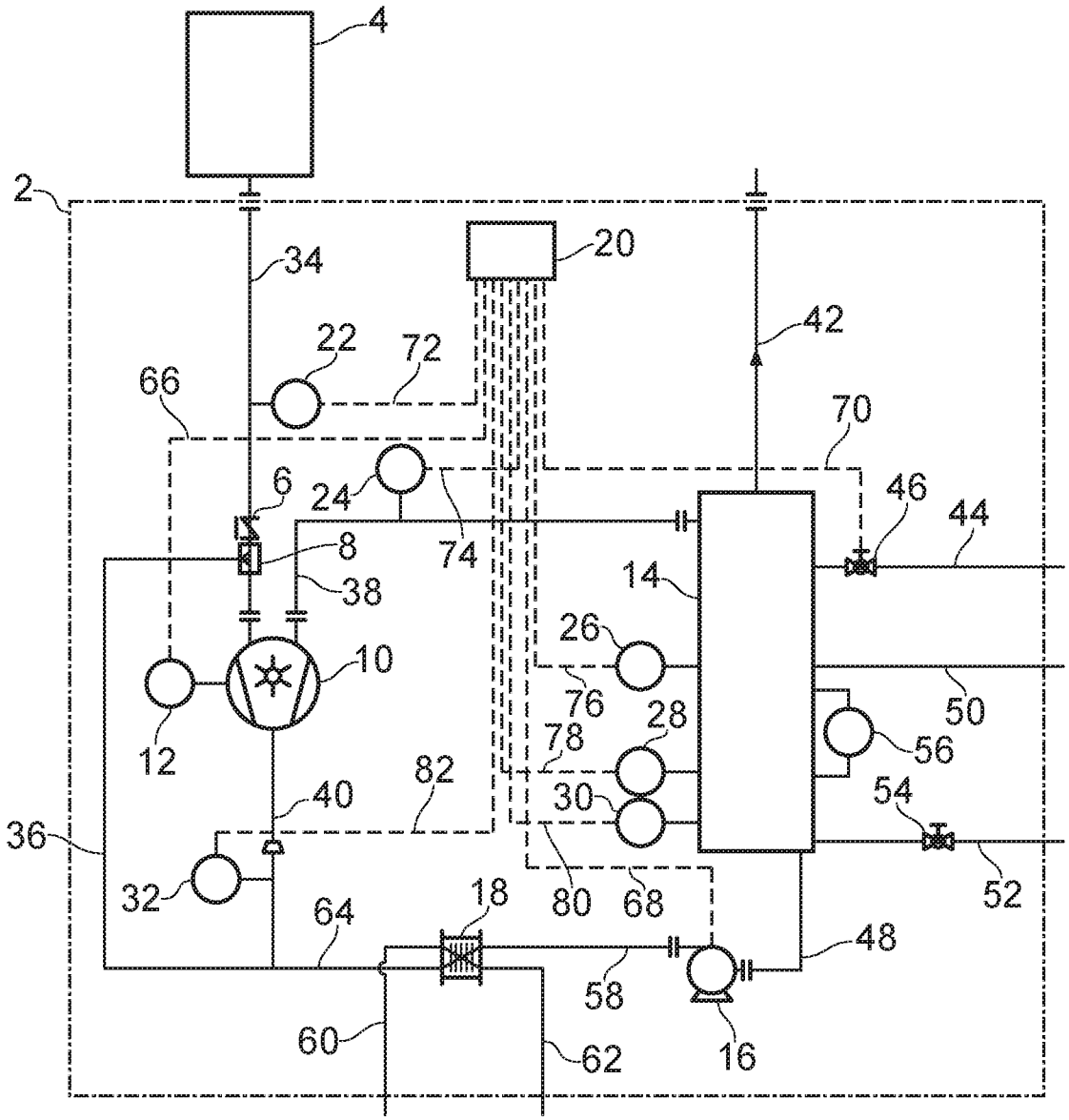
FIG. 1 is a schematic illustration (not to scale) showing a vacuum system.

FIG. 1 is a schematic illustration (not to scale) showing a vacuum system 2. The vacuum system 2 is coupled to a facility 4 such that, in operation, the vacuum system 2 establishes a vacuum or low-pressure environment at the facility 4 by drawing gas (for example, air) from the facility 4.

In this embodiment, the vacuum system 2 comprises a non-return valve 6, one or more spray nozzles 8, a liquid ring pump 10, a motor 12, a separator 14, a pump system 16, a heat exchanger 18, a controller 20, a first pressure sensor 22, a first temperature sensor 24, a second pressure sensor 26, a first level sensor 28, a second level sensor 30, and a second temperature sensor 32.

The facility 4 is connected to an inlet of the liquid ring pump 10 via a suction or vacuum line or pipe 34.

The non-return valve 6 and the spray nozzle are disposed on the suction line 34. The non-return valve 6 is disposed between the facility 4 and the spray nozzle 8. The spray nozzle 8 is disposed between the non-return valve 6 and the liquid ring pump 10.

The non-return valve 6 is configured to permit the flow of fluid (e.g. a gas such as air) from the facility 4 to the liquid ring pump 10, and to prevent or oppose the flow of fluid in the reverse direction, i.e. from the liquid ring pump 10 to the facility 4.

The spray nozzle 8 is coupled to the heat exchanger 18 via a first operating liquid pipe 36. The spray nozzle 8 is configured to receive an operating liquid (which in this embodiment is water) from the heat exchanger 18 via the first operating liquid pipe 36. The spray nozzle 8 is configured to spray the operating liquid into the suction line 34 such that the operating liquid is mixed with the fluid (e.g. a gas such as air) in the suction line 34.

In this embodiment, the liquid ring pump 10 is a single-stage liquid ring pump.

A gas inlet of the liquid ring pump 10 is connected to the suction line 34. A gas outlet of the liquid ring pump 10 is connected to an exhaust line or pipe 38. The liquid ring pump 10 is coupled to the heat exchanger 18 via a second operating liquid pipe 40. The liquid ring pump 10 is configured to receive the operating liquid from the heat exchanger 18 via the second operating liquid pipe 40. The liquid ring pump 10 is driven by the motor 12.

Figure 2:
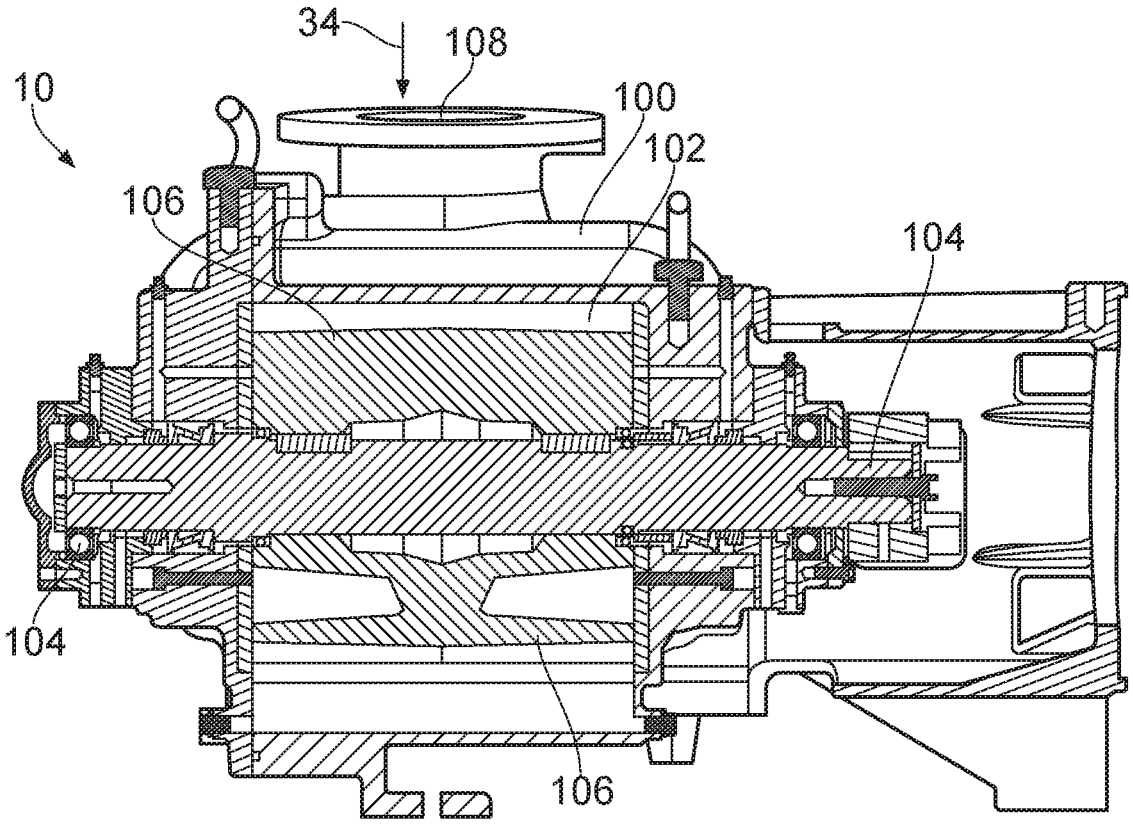
FIG. 2 is a schematic illustration (not to scale) of a liquid ring pump.

FIG. 2 is a schematic illustration (not to scale) of a cross section of an example liquid ring pump 10. The remainder of the vacuum system 2 will be described in more detail later below after a description of the liquid ring pump 10 shown in FIG. 2.

In this embodiment, the liquid ring pump 10 comprises a housing 100 that defines a substantially cylindrical chamber 102, a shaft 104 extending into the chamber 102, and an impeller 106 fixedly mounted to the shaft 104. The gas inlet 108 of the liquid ring pump 10 (which is coupled to the suction line 34) is fluidly connected to a gas intake of the chamber 102. The gas outlet (not shown in FIG. 2) of the liquid ring pump 10 is fluidly connected to a gas output of the chamber 102.

During operation of the liquid ring pump 10, the operating liquid is received in the chamber 102 via the suction line 34 (from the spray nozzle 8) and via the second operating liquid pipe 40. Also, the shaft 104 is rotated by the motor 12, thereby rotating the impeller 106 within the chamber 102. As the impeller 106 rotates, the operating liquid in the chamber 102 (not shown in the Figures) is forced against the walls of the chamber 102 thereby to form a liquid ring that seals and isolates individual volumes between adjacent impeller vanes. Also, gas (such as air) is drawn into the chamber 102 from the suction line 34 via the gas inlet 108 and the gas intake of the chamber 102. This gas flows into the volumes formed between adjacent vanes of the impeller 106. The rotation of the impeller 106 compresses the gas contained within the volume as it is moved from the gas intake of the chamber 102 to the gas output of the chamber 102, where the compressed gas exits the chamber 102. Compressed gas exiting the chamber 102 then exits the liquid ring pump via the gas outlet and the exhaust line 38.

Returning now to the description of FIG. 1, the exhaust line 38 is coupled between the gas outlet of the liquid ring pump 10 and an inlet of the separator 14. The separator 14 is connected to the liquid ring pump 10 via the exhaust line 38 such that exhaust fluid (i.e. compressed gas, which may include water droplets and/or vapour) is received by the separator 14.

The separator 14 is configured to separate the exhaust fluid received from the liquid ring pump 10 into gas (e.g. air) and the operating liquid. Thus, the separator 14 provides for recycling of the operating liquid.

The gas separated from the received exhaust fluid is expelled from the separator 14, and the vacuum system 2, via a system outlet pipe 42.

In this embodiment, the separator 14 comprises a further inlet 44 via which the separator 14 may receive a supply of additional, or "top-up", operating liquid from an operating liquid source (not shown in the Figures). A first valve 46 is disposed along the further inlet 44. The first valve 46 is configured to control the flow of the additional operating liquid into the separator 14 via the further inlet 44. The first valve 46 may be a solenoid valve.

The separator 14 comprises three operating liquid outlets. A first operating liquid outlet of the separator 14 is coupled to the pump system 16 via a second operating liquid pipe 48 such that operating liquid may flow from the separator 14 to the pump system 16. A second operating liquid outlet of the separator 14 is coupled to an overflow pipe 50, which provides an outlet for excess operating liquid. A third operating liquid outlet of the separator 14 is coupled to a drain or evacuation pipe 52, which provides a line via which the separator can be drained of operating liquid. A second valve 54 is disposed along the evacuation pipe 52. The second valve 54 is configured to be in either an open or closed state thereby to allow or prevent the flow of the operating liquid out of the separator 14 via the evacuation pipe 52, respectively. The second valve 54 may be a solenoid valve.

The separator 14 further comprises a level indicator 56 which is configured to provide an indication of the amount of operating liquid in the separator 14, e.g. to a human user of the vacuum system 2. The level indicator 56 may include, for example, a transparent window through which a user may view a liquid level within a liquid storage tank of the separator 14.

In this embodiment, in addition to being coupled to the separator 14 via the second operating liquid pipe 48, the pump system 16 is coupled to the heat exchanger 18 via a third operating liquid pipe 58. The pump system 16 comprises a pump (e.g. a centrifugal pump) and a motor configured to drive that pump. The pump system 16 is configured to pump operating liquid out of the separator 14 via the second operating liquid pipe 48, and to pump that operating liquid to the heat exchanger 18 via the third operating liquid pipe 58.

The heat exchanger 18 is configured to receive relatively hot operating liquid from the pump system 16, to cool that relatively hot operating liquid to provide relatively cool operating liquid, and to output that relatively cool operating liquid.

In this embodiment, the heat exchanger 18 is configured to cool the relatively hot operating liquid flowing through the heat exchanger 18 by transferring heat from that relatively hot operating liquid to a fluid coolant also flowing through the heat exchanger 18. The operating liquid and the coolant are separated in the heat exchanger 18 by a solid wall via which heat is transferred, thereby to prevent mixing of the operating liquid with the coolant. The heat exchanger 18 receives the coolant from a coolant source (not shown in the Figures) via a coolant inlet 60. The heat exchanger 18 expels coolant (to which heat has been transferred) via a coolant outlet 62.

The heat exchanger 18 comprises an operating liquid outlet from which the cooled operating liquid flows (i.e. is pumped by the pump system 16). The operating liquid outlet is coupled to a fourth operating liquid pipe 64. In this embodiment, the fourth operating liquid pipe 64 is connected to the first and second operating liquid pipes 36, 40. Thus, the heat exchanger 18 is connected to the spray nozzle 8 via the fourth operating liquid pipe 64 and the first operating liquid pipe 36 such that, in operation, the cooled operating liquid is pumped by the pump system 16 from the heat exchanger 18 to the spray nozzle 8. Also, the heat exchanger 18 is connected to the liquid ring pump 10 via the fourth operating liquid pipe 64 and the second operating liquid pipe 40 such that, in operation, the cooled operating liquid is pumped by the pump system 16 from the heat exchanger 18 to the liquid ring pump 10.

The controller 20 may comprise one or more processors. In this embodiment, the controller 20 comprises two variable frequency drives (VFD). One of the VFDs is configured to control the speed of the motor 12. The other of the VFDs is configured to control the speed of the motor of the pump system 16. As described in more detail later below with reference to FIGS. 3 and 4, the controller 20 is configured to receive sensor measurements from the sensors 22-32. The controller 20 is further configured to process some or all of these sensor measurements, and based on this sensor data processing control operation of the motor 12 and the pump system 16, via the VFDs.

The controller 20 is connected to the motor 12 via a first of its VFDs and via a first connection 66 such that a control signal for controlling the motor 12 may be sent from the controller 20 to the motor 12. The first connection 66 may be any appropriate type of connection including, but not limited to, an electrical wire or an optical fibre, or a wireless connection. The motor 12 is configured to operate in accordance with the control signal received by it from the controller 20. Control of the motor 12 by the controller 20 is described in more detail later below with reference to FIG. 4.

The controller 20 is connected to the pump system 16 via a second of its VFDs and via a second connection 68 such that a control signal for controlling the pump system 16 may be sent from the controller 20 to the motor of the pump system 16. The second connection 68 may be any appropriate type of connection including, but not limited to, an electrical wire or an optical fibre, or a wireless connection. The pump system 16 is configured to operate in accordance with the control signal received by it from the controller 20. Control of the pump system 16 by the controller 20 is described in more detail later below with reference to FIG. 3.

The controller 20 is connected to the first valve 46 via a third connection 70 such that a control signal for controlling the first valve 46 may be sent from the controller 20 to the first valve 46. The third connection 70 may be any appropriate type of connection including, but not limited to, an electrical wire or an optical fibre, or a wireless connection. The first valve 46 is configured to switch between its open and closed state (thereby to allow or prevent the flow of the additional operating liquid into the separator 14, respectively) in accordance with the control signal received by it from the controller 20.

The first pressure sensor 22 is coupled to the suction line 34 between the facility 4 and the non-return valve 6. The first pressure sensor 22 is configured to measure a pressure of the gas flowing in the suction line 34, i.e. the pressure of the gas being pumped from the facility 4 by the action of the liquid ring pump 10. The first pressure sensor 22 may be any appropriate type of pressure sensor. The first pressure sensor 22 is connected to the controller 20 via a fourth connection 72 such that the measurements taken by the first pressure sensor 22 are sent from the first pressure sensor 22 to the controller 20. The fourth connection 72 may be any appropriate type of connection including, but not limited to, an electrical wire or an optical fibre, or a wireless connection.

The first temperature sensor 24 is coupled to the exhaust line 38 between the liquid ring pump 10 and the separator 14. The first temperature sensor 24 is configured to measure a temperature of the exhaust fluid of the liquid ring pump 10 flowing in the exhaust line 38, i.e. the temperature of the air and water mixture being pumped by the liquid ring pump 10 to the separator 14. The first temperature sensor 24 may be any appropriate type of temperature sensor. The first temperature sensor 24 is connected to the controller 20 via a fifth connection 74 such that the measurements taken by the first temperature sensor 24 are sent from the first temperature sensor 24 to the controller 20. The fifth connection 74 may be any appropriate type of connection including, but not limited to, an electrical wire or an optical fibre, or a wireless connection.

The second pressure sensor 26 is coupled to the separator 14. The second pressure sensor 26 is configured to measure a pressure of fluid within the separator 14. The second pressure sensor 26 may be any appropriate type of pressure sensor, and may include a combined pressure sensor and switch. The second pressure sensor 26 is connected to the controller 20 via a sixth connection 76 such that the measurements taken by the second pressure sensor 26 are sent from the second pressure sensor 26 to the controller 20. The sixth connection 76 may be any appropriate type of connection including, but not limited to, an electrical wire or an optical fibre, or a wireless connection.

In some embodiments, the controller 20 is configured to control operation of one or both of the motor 12 and the pump system 16 (e.g. via respective VFDs) based on measurements received from the second pressure sensor 26. For example, if measurements received from the second pressure sensor 26 indicate that the pressure in the separator 14 is too high (e.g. above a predetermined threshold value, such as 0.5 bar(g)), the controller 20 may reduce the speed of or shut down one or both of the motor 12 and the pump system 16. The controller 20 may display a warning to a user of the vacuum system prior to controlling or shutting down one or both of the motor 12 and the pump system 16, thereby allowing the user to perform remedial action prior to the controller 20 acting.

The first level sensor 28 is coupled to the separator 14. The first level sensor 28 is configured to detect or measure a level of the operating liquid within the separator 14, e.g. within the storage tank of the separator 14. In particular, in this embodiment, the first level sensor 28 is configured to detect when the operating liquid level within the separator 14 reaches a first level corresponding to maximum level for the separator 14. The first level sensor 28 is connected to the controller 20 via a seventh connection 78 such that, in the event that the operating liquid level within the separator 14 reaches the first (maximum) level, a corresponding signal or indication is sent from the first level sensor 28 to the controller 20. The seventh connection 78 may be any appropriate type of connection including, but not limited to, an electrical wire or an optical fibre, or a wireless connection.

The second level sensor 30 is coupled to the separator 14. The second level sensor 30 is configured to detect or measure a level the operating liquid within the separator 14, e.g. within the storage tank of the separator 14. In particular, in this embodiment, the second level sensor 30 is configured to detect when the operating liquid level within the separator 14 reaches a second level corresponding to minimum level for the separator 14. The second level sensor 30 is connected to the controller 20 via an eighth connection 80 such that, in the event that the operating liquid level within the separator 14 reaches the second (minimum) level, a corresponding signal or indication is sent from the second level sensor 30 to the controller 20. The eighth connection 80 may be any appropriate type of connection including, but not limited to, an electrical wire or an optical fibre, or a wireless connection.

In some embodiments, the controller 20 is configured to control operation of the first valve 46 based on measurements received from the first and/or second level sensors 28, 30. For example, if measurements received from the second level sensor 30 indicate that the operating liquid level is at or below the minimum level, the controller 20 may open the first valve 46 thereby to allow additional operating liquid to flow into the separator 14. If measurements received from the second level sensor 30 indicate that the operating liquid level is at or above the maximum level, the controller 20 may close the first valve 46 thereby preventing additional operating liquid to flow into the separator 14. In some embodiments, the controller 20 also controls operation of the second valve 54 via a communication link not shown in the Figures. The controller 20 may control operation of the second valve 54 based on measurements received from the first and/or second level sensors 28, 30. For example, if measurements received from the first level sensor 28 indicate that the operating liquid level is at or above the maximum level, the controller 20 may open the second valve 54 thereby to allow operating liquid to drain out of the separator 14. In some embodiments, the second valve 54 is a manual valve operated by a user.

The second temperature sensor 32 is coupled to the second operating liquid pipe 40 between the heat exchanger 18 and the liquid ring pump 10. The second temperature sensor 32 is configured to measure a temperature of the operating liquid flowing (i.e. being pumped by the pump system 16) into the liquid ring pump 10 via the second operating liquid pipe 40. The second temperature sensor 32 may be any appropriate type of temperature sensor. The second temperature sensor 32 is connected to the controller 20 via a ninth connection 82 such that the measurements taken by the second temperature sensor 32 are sent from the second temperature sensor 32 to the controller 20. The ninth connection 82 may be any appropriate type of connection including, but not limited to, an electrical wire or an optical fibre, or a wireless connection.

Thus, an embodiment of the vacuum system 2 is provided.

Apparatus, including the controller 20, for implementing the above arrangement, and performing the method steps to be described later below, may be provided by configuring or adapting any suitable apparatus, for example one or more computers or other processing apparatus or processors, and/or providing additional modules. The apparatus may comprise a computer, a network of computers, or one or more processors, for implementing instructions and using data, including instructions and data in the form of a computer program or plurality of computer programs stored in or on a machine-readable storage medium such as computer memory, a computer disk, ROM, PROM etc., or any combination of these or other storage media.

Embodiments of control processes performable by the vacuum system 2 will now be described with reference to FIGS. 3 and 4. It should be noted that certain of the process steps depicted in the flowcharts of FIGS. 3 and 4 and described below may be omitted or such process steps may be performed in differing order to that presented below and shown in FIGS. 3 and 4. Furthermore, although all the process steps have, for convenience and ease of understanding, been depicted as discrete temporally-sequential steps, nevertheless some of the process steps may in fact be performed simultaneously or at least overlapping to some extent temporally.

Figure 3:
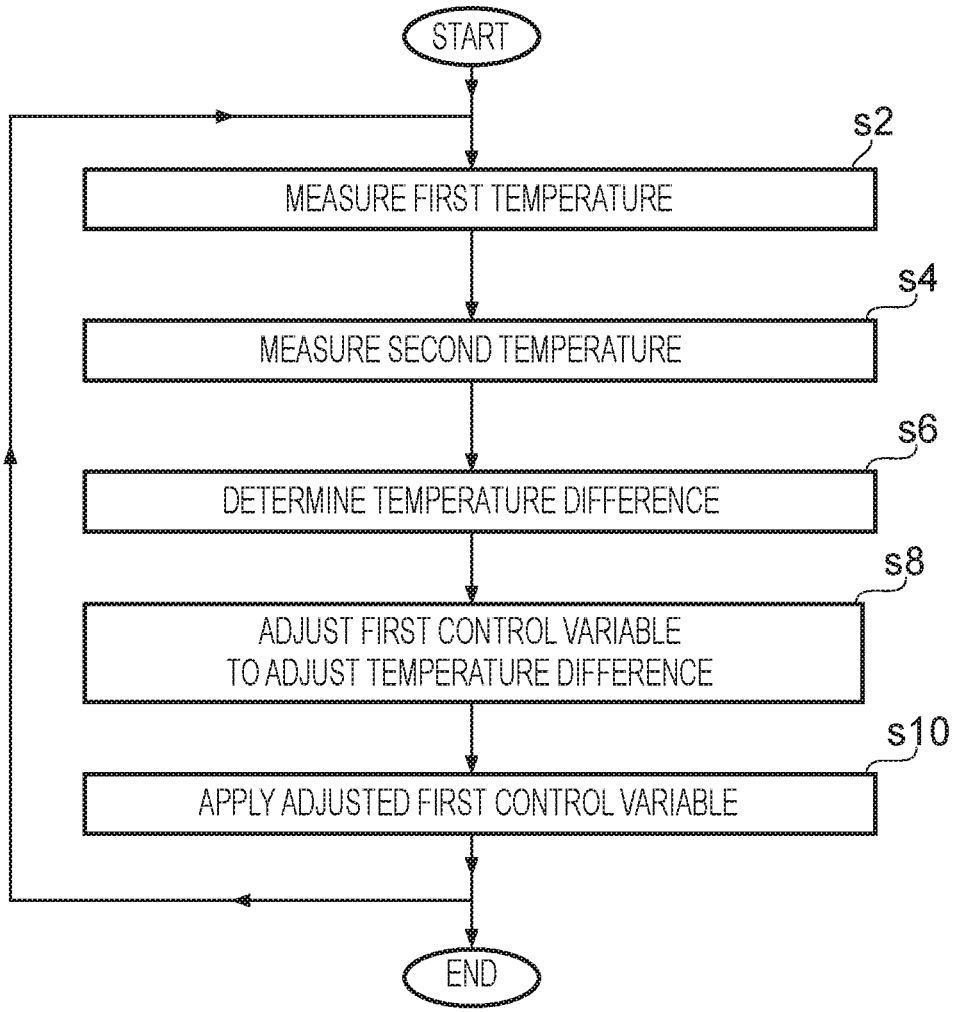
FIG. 3 is a process flow chart showing certain steps of a first control process implemented by the vacuum system.

FIG. 3 is a process flow chart showing certain steps of an embodiment of a first control process implemented by the vacuum system 2 in operation.

At step s2, the first temperature sensor 24 measures a first temperature $T_1$. The first temperature $T_1$ is a temperature of the exhaust fluid of the liquid ring pump 10 flowing in the exhaust line 38, i.e. the temperature of the air and water mixture being pumped by the liquid ring pump 10 to the separator 14. The first temperature $T_1$ measurement is sent by the first temperature sensor 24 to the controller 20 via the fifth connection 74.

At step s4, the second temperature sensor 32 measures a second temperature $T_2$. The second temperature $T_2$ is a temperature of the operating liquid being received by the liquid ring pump 10 via the second operating liquid pipe 40. The second temperature $T_2$ measurement is sent by the second temperature sensor 32 to the controller 20 via the ninth connection 82.

At step s6, the controller 20 determines a temperature difference as the difference between the measured first temperature $T_1$ and the measured second temperature $T_2$. Thus, in this embodiment, the temperature difference ΔT is calculated as:

$$\Delta T = T_1 - T_2$$

At step s8, the controller 20 acts to reduce or minimize the temperature difference ΔT by adjusting of a first control variable $v_1(t)$.

In some embodiments, the controller 20 attempts to equalise the temperature difference ΔT with a first threshold value, or to cause the temperature difference ΔT to be within a first threshold range (e.g. a first threshold value +/− a constant). The first threshold value may be any appropriate value, for example 1° C., 1.5° C., 2° C., 2.5° C., or 3° C. The first threshold value may be determined by testing, for example to determine a threshold value associated with high or optimum liquid ring pump efficiency. The first threshold value may be dependent on a size or power of the liquid ring pump 10.

In this embodiment, the first control variable $v_1(t)$ is an operating speed of the motor of the pump system 16.

In this embodiment, the controller 20 is a proportional-integral (PI) controller. Thus, the controller 20 applies correction/adjustment to the first control variable $v_1(t)$ based on proportional and integral terms of the temperature difference ΔT. The adjusted value of the first control variable $v_1(t)$ may be determined as a weighted sum of the control terms (i.e. of the proportional and integral parameters determined by the controller 20).

In this embodiment, if the temperature difference ΔT is too high, for example ΔT is above a threshold value such as the abovementioned first threshold value, the controller 20 increases the first control variable $v_1(t)$. (Increasing the first control variable $v_1(t)$ corresponds to speeding up the pump system 16).

Similarly, if the temperature difference ΔT is too low, for example ΔT is below a threshold value such as the abovementioned first threshold value, the controller 20 decreases the first control variable $v_1(t)$. (Decreasing the first control variable $v_1(t)$ corresponds to slowing down the pump system 16.)

At step s10, the controller 20 controls (using a VFD) the pump system 16 using the adjusted first control variable $v_1(t)$.

In particular, the controller 20 generates a control signal for the motor pump system 16 based on the adjusted first control variable $v_1(t)$ determined at step s8. This control signal is then sent from the controller 20 to the pump system 16 via the second connection 68. The pump system 16 operates in accordance with the received control signal.

Thus, in the event that the temperature difference ΔT is too high, the pump system 16 is sped up in accordance with the increased first control variable $v_1(t)$. Thus, the flow rate of relatively cool operating liquid into the liquid ring pump 10 is increased. This tends to cause a reduction in the first temperature $T_1$ measured by the first temperature sensor 24, thereby reducing the temperature difference ΔT.

Similarly, in the event that the temperature difference ΔT is too low, the pump system 16 is slowed down in accordance with the decreased first control variable $v_1(t)$. Thus, the flow rate of relatively cool operating liquid into the liquid ring pump 10 is decreased. This tends to cause an increase in the first temperature $T_1$ measured by the first temperature sensor 24, thereby increasing the temperature difference ΔT.

After step s10, the process of FIG. 3 repeats, for example until the vacuum system 2 is shutdown. The process of FIG. 3 may be performed continually, or more preferably continuously during operation of the vacuum system 2.

Thus, an embodiment of a first control process implemented by the vacuum system 2 is provided. The first control process comprises a control loop feedback mechanism in which continuously modulated control of the pump system 16 is performed.

Advantageously, the above described system and first control process allows for the control of operating liquid temperature in a liquid ring pump.

The above described system and first control process advantageously tends to provide for improved performance and efficiency of the liquid ring pump.

The above described system and first control process advantageously tends to reduce the likelihood of overloading the liquid ring pump with operating liquid. Furthermore, the likelihood and/or severity of hydraulic shock (also called "water hammer") tends to be reduced. This tends to reduce damage to the liquid ring pump. Advantageously, the above described system and first control process tends to provide reduced or minimised operating liquid consumption. The operating liquid tends to be recycled in the above described system and first control process. This tends to reduce operating costs of the liquid ring pump.

The above described system and first control process advantageously tends to reduce the likelihood and/or severity of cavitation occurring in the liquid ring pump.

Advantageously, if the thermal load of the above described system is low, the pump system will tend to slow down. Thus, energy consumption tends to be reduced.

The speed that the liquid ring pump 10 is running, i.e. the speed that the motor 12 drives the liquid ring pump 10, may be dependent on how close the actual inlet pressure (i.e. the pressure in the suction line 34) is to a target inlet pressure which may be defined by the facility 4. Furthermore, the speed that the liquid ring pump 10 is running can be limited by the so-called "anti-cavitation control" process which will now be described in more detail with reference to FIG. 4.

Figure 4:
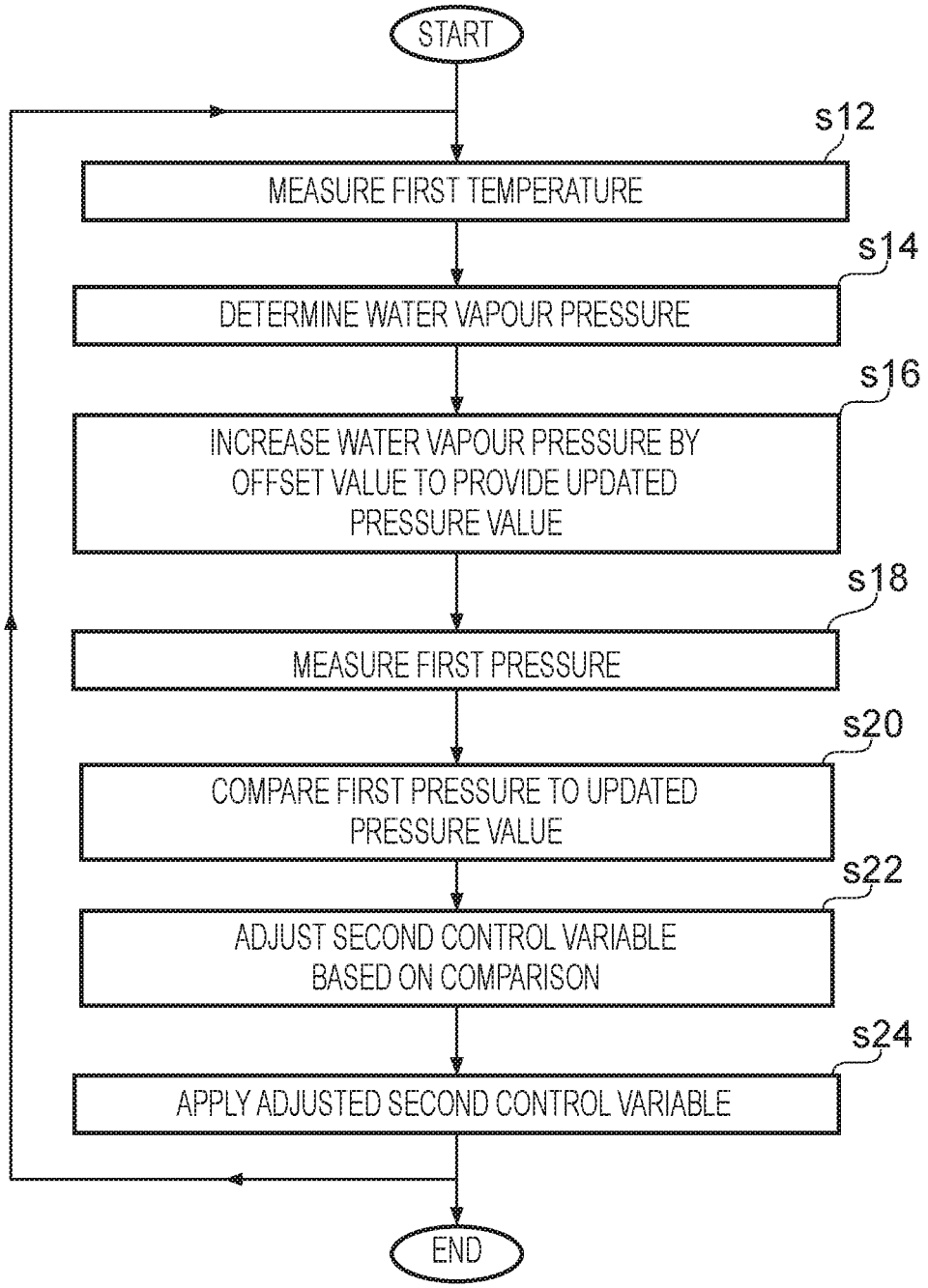
FIG. 4 is a process flow chart showing certain steps of a second control process implemented by the vacuum system.

FIG. 4 is a process flow chart showing certain steps of an embodiment of a second control process implemented by the vacuum system 2 in operation. The process of FIG. 4 may be regarded as an "anti-cavitation control" process.

At step s12, the first temperature sensor 24 measures a first temperature $T_1$. The first temperature $T_1$ is a temperature of the exhaust fluid of the liquid ring pump 10 flowing in the exhaust line 38, i.e. the temperature of the air and water mixture being pumped by the liquid ring pump 10 to the separator 14. The first temperature $T_1$ measurement is sent by the first temperature sensor 24 to the controller 20 via the fifth connection 74.

At step s14, the controller 20 determines or estimates the vapour pressure of the operating liquid in the liquid ring pump 10 using the measured first temperature $T_1$. In this embodiment, the operating liquid is water and, thus, the controller determines the vapour pressure of water for the first temperature $T_1$, which is hereafter referred to as "the water vapour pressure $P_{wv}$". In this embodiment, the water vapour pressure $P_{wv}$ is determined using an approximation formula, in particular the Antoine equation. The water vapour pressure $P_{wv}$ is determined as:

$$P_{wv} = A * 10^{\left(\frac{m*T_1}{T_1+T_n}\right)}$$

where: A is a constant value, for example, A may be between about 6.1 and 6.2, e.g. A=6.116441;

m is a constant value, for example, m may be between about 7.5 and 7.6, e.g. m=7.591386;

$T_n$ is a constant value (in Kelvin), for example, $T_n$ may be between about 240 and 241 Kelvin, e.g. $T_n$=240.7263 K; and $T_1$ is the measured first temperature.

In some embodiments, one or more of the parameters A, m, and $T_n$ may have different value to that given above.

At step s16, the controller 20 adds a so-called offset value to the determined water vapour pressure $P_{wv}$, thereby to determine an updated pressure value. Thus, in this embodiment the updated pressure value P is determined as:

$$P=P_{wv}+P_{offset}$$

where: $P_{offset}$ is the offset value.

The offset value $P_{offset}$ may be considered to be a safety margin. The offset value $P_{offset}$ may be any appropriate value including but not limited to a value between 1 mbar and 10 mbar, e.g. 1 mbar, 2 mbar, 3 mbar, 4 mbar, 5 mbar, 6 mbar, 7 mbar, 8 mbar, 9 mbar, or 10 mbar. In some embodiments, use of the offset value $P_{offset}$ is omitted.

At step s18, the first pressure sensor 22 measures a first pressure P1, the first pressure P1 being the pressure of the gas flowing in the suction line 34, i.e. the pressure P1 of the gas being pumped from the facility 4 by the action of the liquid ring pump 10. The first pressure P1 measurement is sent by the first pressure sensor 22 to the controller 20 via the fourth connection 72.

At step s20, the controller 20 compares the measured first pressure P1 to the determined updated pressure value P.

For example, the controller 20 determines an error value as the difference between the measured first pressure $P_1$ and the determined updated pressure value P. Thus, the error value ΔP may be calculated as:

$$\Delta P=P_1-P$$

At step s22, the controller 20 adjusts a second control variable $v_2(t)$ based on the comparison performed at step s20. For example, the controller 20 may act to increase the error value ΔP by adjusting a second control variable $v_2(t)$.

In some embodiments, the controller 20 may adjust the second control variable $v_2(t)$ if the error value ΔP is equal to a second threshold value (e.g. if ΔP=0) or within a second threshold range (e.g. if ΔP≤0). The controller 20 may adjust the second control variable $v_2(t)$ to cause the error value ΔP to increase.

In this embodiment, the second control variable $v_2(t)$ is an operating speed of the motor 12. The controller 20 may adjust the second control variable $v_2(t)$ to cause an increase in the error value ΔP by adjusting or varying the second control variable $v_2(t)$ in a way that would cause a decrease in the operating speed of the motor 12. This reduction in operating speed of the motor 12 would tend to cause the liquid ring pump 10 to draw less gas from the facility 4 in a given time, which would tend to cause an increase in the pressure of the gas flowing in the suction line 34, i.e. the first pressure $P_1$.

In this embodiment, the controller 20 is a proportional-integral (PI) controller. Thus, the controller 20 applies correction/adjustment to the second control variable $v_2(t)$ based on proportional and integral terms, e.g., of the error value ΔP. The adjusted value of the second control variable $v_2(t)$ may be determined as a weighted sum of the control terms (i.e. of the proportional and integral parameters determined by the controller 20).

In this embodiment, if the error value ΔP is too high, for example ΔP is above a threshold value or above a desired threshold range such as the abovementioned second threshold value or range, the controller 20 increases the second control variable $v_2(t)$. (Increasing the second control variable $v_2(t)$ corresponds to speeding up the motor 12 driving the liquid ring pump 10, which causes gas to be removed from the facility 4 more quickly, thereby decreasing the first pressure $P_1$ of the gas flowing in the suction line 34.)

Similarly, if the error value ΔP is too low, for example ΔP is below a threshold value or below a desired threshold range such as the abovementioned second threshold value or range, the controller 20 decreases the second control variable $v_2(t)$. (Decreasing the second control variable $v_2(t)$ corresponds to slowing down the motor 12 driving the liquid ring pump 10, which causes gas to be removed from the facility 4 less quickly, which may result in an increase in the first pressure $P_1$ of the gas flowing in the suction line 34.)

At step s24, the controller 20 controls the motor 12 using the adjusted second control variable $v_2(t)$.

In particular, the controller 20 generates a control signal for the motor 12 based on the adjusted second control variable $v_2(t)$ determined at step s22. This control signal is then sent from the controller 20 to the motor 12 via the first connection 66. The motor 12 operates in accordance with the received control signal.

In the event that the error value ΔP is negative, the motor 12 is slowed down in accordance with the decreased second control variable $v_2(t)$. Thus, the operating speed of the liquid ring pump 10 is decreased resulting in a decrease of the flow rate of gas through the suction line 34 from the facility 4. This tends to cause an increase in the first pressure $P_1$ measured by the first pressure sensor 22, thereby increasing the error value ΔP.

Increasing the error value ΔP means that the difference between the first pressure $P_1$ and the water vapour pressure $P_{wv}$ is increased. In other words, the pressure of the gas received by the liquid ring pump is moved away from the water vapour pressure $P_{wv}$. This advantageously tends to reduce the likelihood of the inlet gas causing cavitation in the liquid ring pump 10.

After step s24, the process of FIG. 4 repeats, for example until the vacuum system 2 is shutdown. The process of FIG. 4 may be performed continually, or more preferably continuously during operation of the vacuum system 2.

Thus, an embodiment of a second control process implemented by the vacuum system 2 is provided. The second control process comprises a control loop feedback mechanism in which continuously modulated control of the motor 12 is performed. Advantageously, the above described system and second control process tends to allow for the control of fluid temperatures and pressures within a liquid ring pump.

The above described system and second control process advantageously tends to provide for improved reliability of the liquid ring pump.

The above described system and second control process advantageously tends to reduce the likelihood and/or severity of cavitation occurring in the liquid ring pump. For example, cavitation may be caused in the liquid ring pump by the inlet pressure (i.e. the pressure of gas from the suction line) being at or below the vapour pressure of the operating liquid in the liquid ring pump. The above described second control process advantageously tends to adjust the inlet pressure to move it away from vapour pressure of the operating liquid, thereby reducing the likelihood of cavitation. Thus, damage to the liquid ring pump caused by cavitation tends to be reduced or eliminated.

In the above described control processes, the liquid ring pump is operated with variable speed drive (VSD). In other words, the controller controls the liquid ring pump to vary the speed at which the liquid ring pump pumps gas from the facility. When VSD is used, there may be a risk of the liquid ring pump shutting down if it is run at too low a speed. If the liquid ring pump was to shut down, gas from the chamber of the liquid ring pump may attempt to flow back from the chamber and out of the liquid ring pump to the facility. The non-return valve advantageously tends to prevent or oppose this undesirable flow of gas, and is particularly beneficial for the liquid ring pump operated using VSD.

Advantageously, the spray nozzle may be operated to vary the temperature of the operating liquid entering the liquid ring pump.

In the above embodiments, the vacuum system comprises the elements described above with reference to FIG. 1. In particular, the vacuum system comprises the non-return valve, the spray nozzle, the liquid ring pump, the motor, the separator, the pump, the heat exchanger, the controller, the first and second pressure sensors, the first and second temperature sensors, and the first and second level sensors, and the connections therebetween. However, in other embodiments the vacuum system comprises other elements instead of or in addition to those described above. Also, in other embodiments, some or all of the elements of the vacuum system may be connected together in a different appropriate way to that described above. For example, in some embodiments, one or more of the non-return valve, the spray nozzle, the pressure sensors, the temperature sensors, and the level sensors may be omitted. In some embodiments, multiple liquid ring pumps may be implemented.

In the above embodiments, the heat exchanger cools the operating liquid flowing therethrough. However, in other embodiments other cooling means are implemented to cool the operating liquid prior to it being received by the liquid ring pump, instead of or in addition to the heat exchanger.

In the above embodiments, a separator is implemented to recycle the operating liquid back into the liquid ring pump. However, in other embodiments a different type of recycling technique is implemented. The recycling of the operating liquid advantageously tends to reduce operating costs and water usage. Nevertheless, in some embodiments, recycling of the operating liquid is not performed. For example, the vacuum system may include an open loop operating liquid circulation system in which fresh operating liquid is supplied to the liquid ring pump, and expelled operating liquid may be discarded. Thus, the separator may be omitted.

In the above embodiments, the liquid ring pump is a single-stage liquid ring pump. However, in other embodiments the liquid ring pump is a different type of liquid ring pump, for example a multi-stage liquid ring pump.

In the above embodiments, the operating liquid is water. However, in other embodiments, the operating liquid is a different type of operating liquid.

In the above embodiments, the controller is a PI controller. However, in other embodiments, the controller is a different type of controller such as a proportional (P) controller, an integral (I) controller, a derivative (D) controller, a proportional-derivative controller (PD) controller, a proportional-integral-derivative controller (PID) controller, or a fuzzy logic controller.

In the above embodiments, a single controller controls operation of multiple system elements (e.g. the motors). However, in other embodiments multiple controllers may be used, each controlling a respective subset of the group of elements. For example, in some embodiments, each motor may have a respective dedicated controller.

In the above embodiments, the temperature difference is determined to be $\Delta T = T_1 - T_2$. However, in other embodiments the temperature difference is determined in a different way, for example using a different appropriate formula. For example, the temperature difference may be a different function of the first temperature $T_1$ and/or the second temperature $T_2$. For example, weights may be applied to the measured temperatures $T_1$ and $T_2$.

In the above embodiments, the Antoine equation is used to estimate the water vapour pressure $P_{wv}$ as $$P_{wv} = A * 10^{\left(\frac{m * T_1}{T_1 + T_n}\right)}.$$

However, in other embodiments, the water vapour pressure in a different appropriate way, for example using a different approximation such as the August-Roche-Magnus (or Magnus-Tetens or Magnus) equation, the Tetens equation, the Buck equation, or the Goff-Gratch equation. In some embodiments, the water vapour pressure $P_{wv}$ is determined as $$P_{wv} = 20.386 - \frac{5132}{T_1}.$$

In the above embodiments, the error value ΔP is determined to be $\Delta P = P_1 - P$. However, in other embodiments the error value is determined in a different way, for example using a different appropriate formula. For example, the error value may be a different function of the first pressure $P_1$ and/or the first temperature $T_1$. In some embodiments, weights may be applied to the measured pressure $P_1$ and/or the updated pressure value P.

In the above embodiments, the pump is controlled to regulate or modulate flow of the operating liquid into the liquid ring pump. However, in other embodiments, one or more different type of regulating device is implemented instead of or in addition to the pump, for example one or more valves for controlling a flow of operating fluid. The controller may be configured to control operation of the one or more regulating devices.

In the above embodiments, the first control process (described in more detail above with reference to FIG. 3) is implemented to control operation of the pump, and thereby control the operating liquid received by the liquid ring pump. However, in other embodiments, this first control process is omitted, or a different process for controlling the pump and the flow of the operating liquid is implemented instead.

The invention claimed is:

1. A system comprising:

a suction line;

an exhaust line;

an operating liquid line;

a liquid ring pump comprising a suction input coupled to the suction line, an exhaust output coupled to the exhaust line, and a liquid input coupled to the operating liquid line;

a motor configured to drive the liquid ring pump;

a first sensor configured to measure a first parameter, the first parameter being a parameter of an exhaust fluid of the liquid ring pump;

a second sensor configured to measure a second parameter, the second parameter being a parameter of a gas being received by the liquid ring pump via the suction line; and a controller operatively coupled to the first sensor, the second sensor, and the motor, and configured to:

calculate a vapor pressure of an operating liquid based on the equation:

$$P_{wv} = A * 10^{\left(\frac{m*T_1}{T_1+T_n}\right)}$$

where A is a constant, m is a constant, $T_n$ is a constant, and $T_1$ is the first parameter; and control the motor based on a function of the second parameter and the vapor pressure of the operating liquid.

2. The system according to claim 1, wherein the first parameter is a temperature.

3. The system according to claim 1, wherein the second parameter is a pressure.

4. The system according to claim 1, wherein the function of the second parameter and the vapor pressure of the operating liquid is:

$$\Delta P = P_1 - P$$

where $P_1$ is the second parameter, and $$P = P_{wv} + P_{offset}$$

where $P_{wv}$ is the vapor pressure of the operating liquid and $P_{offset}$ is an offset value.

5. The system according to claim 1, wherein the controller is configured to determine an operating speed for the motor based on sensor measurements of the first sensor and the second sensor, and to control the motor in accordance with the determined operating speed.

6. The system according to claim 1, wherein the controller is a controller selected from the group of controllers consisting of a proportional controller, an integral controller, a derivative controller, a proportional-integral controller, a proportional—integral—derivative controller, a proportional—derivative controller, and a fuzzy logic controller.

7. The system according to claim 1, further comprising an operating liquid recycling system configured to recycle operating liquid in the exhaust fluid of the liquid ring pump back into the liquid ring pump.

8. The system according to claim 7, wherein the operating liquid recycling system comprises a separator configured to separate operating liquid from the exhaust fluid of the liquid ring pump.

9. The system according to claim 7, wherein the operating liquid recycling system comprises a cooling means configured to cool the recycled operating liquid prior to the recycled operating liquid being received by the liquid ring pump.

10. The system according to claim 1, further comprising a non-return valve disposed on the suction line and configured to permit fluid flow into the liquid ring pump and to oppose fluid flow out of the liquid ring pump.

11. The system according to claim 1, further comprising a spray nozzle disposed on the suction line and configured to receive operating fluid and to spray the received operating fluid into the suction line.

12. The system according to claim 1, further comprising:

one or more regulating devices configured to control flow of the operating liquid into the liquid ring pump; and a third sensor configured to measure a third parameter, the third parameter being a parameter of an operating liquid received by the liquid ring pump via the operating liquid line; wherein the controller is further operatively coupled to the third sensor and the one or more regulating devices and configured to control the one or more regulating devices based on sensor measurements of the first sensor and the third sensor.

13. A method for controlling a system, the system comprising: a suction line; an exhaust line; an operating liquid line; a liquid ring pump comprising a suction input coupled to the suction line, an exhaust output coupled to the exhaust line, and a liquid input coupled to the operating liquid line; and a motor configured to drive the liquid ring pump; the method comprising:

measuring, by a first sensor, a first parameter, the first parameter being a parameter of an exhaust fluid of the liquid ring pump;

measuring, by a second sensor, a second parameter, the second parameter being a parameter of a gas being received by the liquid ring pump via the suction line;

calculating, by a controller operatively coupled to the first sensor, the second sensor, and the motor, a vapor pressure of an operating liquid based on the equation:

$$P_{wv} = A * 10^{\left(\frac{m*T_1}{T_1+T_n}\right)}$$

where A is a constant, m is a constant, $T_n$ is a constant, and $T_1$ is the first parameter; and controlling, by the controller based on based on a function of the second parameter and the vapor pressure of the operating liquid, the motor.

14. The method according to claim 13, further comprising:

recycling the operating liquid in the exhaust fluid of the liquid ring pump back into the liquid ring pump using an operating liquid recycling system.

15. The method according to claim 13, further comprising:

determining, by the controller, an operating speed for the motor based on sensor measurements of the first sensor and the second sensor; and controlling the motor in accordance with the determined operating speed.

* * * * *